US009677010B2

(12) United States Patent
Amin et al.

(10) Patent No.: US 9,677,010 B2
(45) Date of Patent: Jun. 13, 2017

(54) METHODS FOR CATALYTIC REFORMING OF HYDROCARBONS INCLUDING REGENERATION OF CATALYST AND APPARATUSES FOR THE SAME

(71) Applicant: UOP LLC, Des Plaines, IL (US)

(72) Inventors: Shreyas Ketankumar Amin, Vadodara (IN); Sujoy Ganguly, Gurgaon (IN); Kalaiarasu Krishnamani, Tirunelveli (IN)

(73) Assignee: UOP LLC, Des Plaines, IL (US)

( * ) Notice: Subject to any disclaimer, the term of this patent is extended or adjusted under 35 U.S.C. 154(b) by 246 days.

(21) Appl. No.: 14/573,243

(22) Filed: Dec. 17, 2014

(65) Prior Publication Data

US 2016/0177199 A1 Jun. 23, 2016

(51) Int. Cl.
*C10G 35/04* (2006.01)

(52) U.S. Cl.
CPC ..... *C10G 35/04* (2013.01)

(58) Field of Classification Search
CPC .. B01J 8/125; B01J 2208/00176; C10G 35/04
See application file for complete search history.

(56) References Cited

U.S. PATENT DOCUMENTS 3,725,249 A * 4/1973 Vesely ..... B01J 8/125 208/139
3,978,150 A * 8/1976 McWilliams, Jr. ..... B01J 8/12 208/108
3,981,824 A * 9/1976 Greenwood ..... B01J 8/12 222/328
4,578,370 A * 3/1986 Greenwood ..... B01J 8/125 208/140
5,095,709 A 3/1992 Billiot
5,624,964 A 4/1997 Cimini et al.
6,123,833 A * 9/2000 Sechrist ..... C10G 29/205 208/134
8,491,678 B1 7/2013 Bossard
2011/0289924 A1 12/2011 Pietsch

FOREIGN PATENT DOCUMENTS

CN 202447098 U 9/2012

OTHER PUBLICATIONS

McClung et al., Light Oil Catalytic Processing. Reforming. Process., 2000 NPRA Question and Answer Session on Refining and Petrochemical Technology.

* cited by examiner

*Primary Examiner* — Randy Boyer

(57) ABSTRACT

Embodiments of methods and apparatuses for catalytic reforming of hydrocarbons including regeneration of catalyst are provided. In one example, a method comprises heating an inert gas to form a heated inert gas stream. A first portion of the heated inert gas stream is indirect heat exchanged with hydrogen gas to form a first partially heated inert gas stream and a heated hydrogen gas stream that is for lifting the catalyst; and/or a second portion of the heated inert gas stream is indirect heat exchanged with an organic chloride-containing stream to form a second partially heated inert gas stream and a heated organic chloride-containing stream that is for chlorinating the catalyst; and/or the catalyst is preheated using at least a third portion of the heated inert gas stream for indirect heat exchange with a nitrogen gas stream or using the first and/or second partially heated inert gas streams.

15 Claims, 2 Drawing Sheets

METHODS FOR CATALYTIC REFORMING OF HYDROCARBONS INCLUDING REGENERATION OF CATALYST AND APPARATUSES FOR THE SAME

TECHNICAL FIELD

The technical field relates generally to reforming of hydrocarbons, and more particularly relates to methods and apparatuses for catalytic reforming of hydrocarbons including regeneration of a catalyst.

BACKGROUND

High octane gasoline is needed for modern gasoline engines. Previously, octane numbers were often improved by incorporating various lead-containing additives into the gasoline. As lead-containing additives have been phased out of gasoline for environmental reasons, it has become increasingly necessary to rearrange the structure of the hydrocarbons used in gasoline blending to achieve higher octane ratings. Catalytic reforming of hydrocarbons is a process widely used by refiners for upgrading the octane ratings of gasoline as well as for other useful hydrocarbon conversion applications.

In catalytic reforming, a hydrocarbon feedstock of, for example, $C_5$ hydrocarbons to about $C_{11}$ hydrocarbons, is contacted with a reforming catalyst to convert at least a portion of the heavier hydrocarbons to aromatic hydrocarbons, for example, to increase the octane content of gasoline. Invariably, the catalyst used in such processes becomes deactivated for one or more reasons including the accumulation of coke deposits on the catalyst.

Regeneration of the catalyst removes the coke deposits and helps restore the activity of the catalyst. Coke is normally removed from the catalyst by a regeneration operation that contacts the coke-containing catalyst at high temperatures with an oxygen-containing gas to combustively remove the coke. In continuous or semi-continuous catalyst regeneration processes, coke laden particles are at least periodically added and withdrawn from a bed of catalyst in a regeneration vessel in which the coke is combusted. Regions of intense burning that extend through portions of the catalyst bed develop as the coke is combusted. After this intense burning, certain catalysts require further reconditioning to restore their effectiveness. For example, reforming catalyst typically contain chloride compounds and noble metals, such as platinum. These catalysts require reconditioning to restore the activity of the noble metal to its most highly catalytic state and to replace chloride on the catalyst that may be lost in the reaction zone or through the combustion of coke. Reconditioning for a reforming catalyst generally includes contact with a chloride containing compound in a chlorination zone of the regeneration vessel, to redistribute the platinum metal and replace the chloride that may be lost from the catalyst, followed by a drying step to reduce the moisture content of the catalyst and finally a reducing step to change the platinum metal from various oxide states to a reduced metallic condition. The various steps for regenerating catalyst and for moving the catalyst around for regeneration including for reconditioning often require the introduction of heat at various points into the system, which may be supplied, for example, by steam or other source(s) that may be detrimental if it leaks into the system and contacts the catalyst and/or that may be inefficient from an overall process standpoint.

Accordingly, it is desirable to provide apparatuses and methods for catalytic reforming of hydrocarbons with improved heat management for regeneration of a catalyst. Furthermore, other desirable features and characteristics will become apparent from the subsequent detailed description and the appended claims, taken in conjunction with the accompanying drawings and this background.

BRIEF SUMMARY

Methods and apparatuses for catalytic reforming of hydrocarbons including regeneration of a catalyst are provided herein. In accordance with an exemplary embodiment, a method for catalytic reforming of hydrocarbons including regeneration of a catalyst comprises the steps of heating an inert gas to form a heated inert gas stream. At least a first portion of the heated inert gas stream is indirect heat exchange with hydrogen gas to form a first partially heated inert gas stream and a heated hydrogen gas stream that is for lifting the catalyst; and/or at least a second portion of the heated inert gas stream is indirect heat exchange with an organic chloride-containing stream to form a second partially heated inert gas stream and a heated organic chloride-containing stream that is for chlorinating the catalyst; and/or the catalyst is preheated using at least a third portion of the heated inert gas stream for indirect heat exchange with a nitrogen gas stream that is in fluid communication with the catalyst or using the first and/or second partially heated inert gas streams for direct heat exchange with the catalyst.

In accordance with another exemplary embodiment, an apparatus for catalytic reforming of hydrocarbons including regeneration of a catalyst is provided. The apparatus comprises a regenerator that comprises a combustion zone configured to combust coke disposed on the catalyst in the presence of an oxygen-containing gas to form a heated combustion zone gas. A fluid circuit contains an inert gas. A circulating device is operatively coupled to the fluid circuit to advance the inert gas through the fluid circuit. One or more heat exchangers are disposed along the fluid circuit and are configured for indirect heat exchange between the heated combustion zone gas and the inert gas for forming a heated inert gas stream for indirect heat exchange with one or more streams for chlorinating, lifting, and/or preheating the catalyst.

In accordance with another exemplary embodiment, an apparatus for catalytic reforming of hydrocarbons including regeneration of a catalyst is provided. The apparatus comprises a fluid circuit that contains nitrogen gas. A heating device is disposed along the fluid circuit and is configured to receive and heat the nitrogen gas to form a heated nitrogen gas stream. One or more heat exchangers are disposed along the fluid circuit and are configured for indirect heat exchange between hydrogen gas and at least a portion of the heated nitrogen gas stream to form a heated hydrogen gas stream that is for lifting the catalyst and a partially heated nitrogen gas stream that is for preheating spent catalyst to form preheated spent catalyst. A regenerator is for receiving and regenerating the preheated spent catalyst.

BRIEF DESCRIPTION OF THE DRAWINGS

The various embodiments will hereinafter be described in conjunction with the following drawing figures, wherein like numerals denote like elements, and wherein.

DETAILED DESCRIPTION

The following Detailed Description is merely exemplary in nature and is not intended to limit the various embodiments or the application and uses thereof. Furthermore, there is no intention to be bound by any theory presented in the preceding background or the following detailed description.

Various embodiments contemplated herein relate to catalytic reforming of hydrocarbons including regeneration of a catalyst. The exemplary embodiments taught herein heat an inert gas such as nitrogen to form a heated inert gas stream. In an exemplary embodiment, the heated inert gas stream is formed by indirect heat exchanging the inert gas with a heated combustion zone gas that is formed by combusting coke disposed on a catalyst in the presence of an oxygen-containing gas. In another exemplary embodiment, the heated inert gas stream is formed by heating the inert gas with a preheat gas heater that is configured, for example, as an heating device such as an electric heater.

In one embodiment, at least a first portion of the heated inert gas stream is indirect heat exchanged with hydrogen gas to form a first partially heated inert gas stream and a heated hydrogen gas stream that is for lifting the catalyst. In another embodiment, at least a second portion of the heated inert gas stream is indirect heat exchanged with an organic chloride-containing stream to form a second partially heated inert gas stream and a heated organic chloride-containing stream that is for chlorinating the catalyst. In yet another embodiment, the catalyst is preheated using at least a third portion of the heated inert gas stream for indirect heat exchange with a separate nitrogen gas stream that is in fluid communication with the catalyst or using the first and/or second partially heated inert gas streams for direct heat exchange with the catalyst. By using an inert gas such as nitrogen or the like for transferring heat from the heated combustion zone gas formed from burning coke that is disposed on the catalyst, or alternatively, from the preheat gas heater for heat exchange with one or more streams for chlorinating, lifting, and/or preheating the catalyst, heat can be better managed and/or provided more efficiently to the various points for regenerating the catalyst without detrimentally affecting the catalyst if the inert gas unintentionally leaks into the system and contacts the catalyst.

Figure 1:
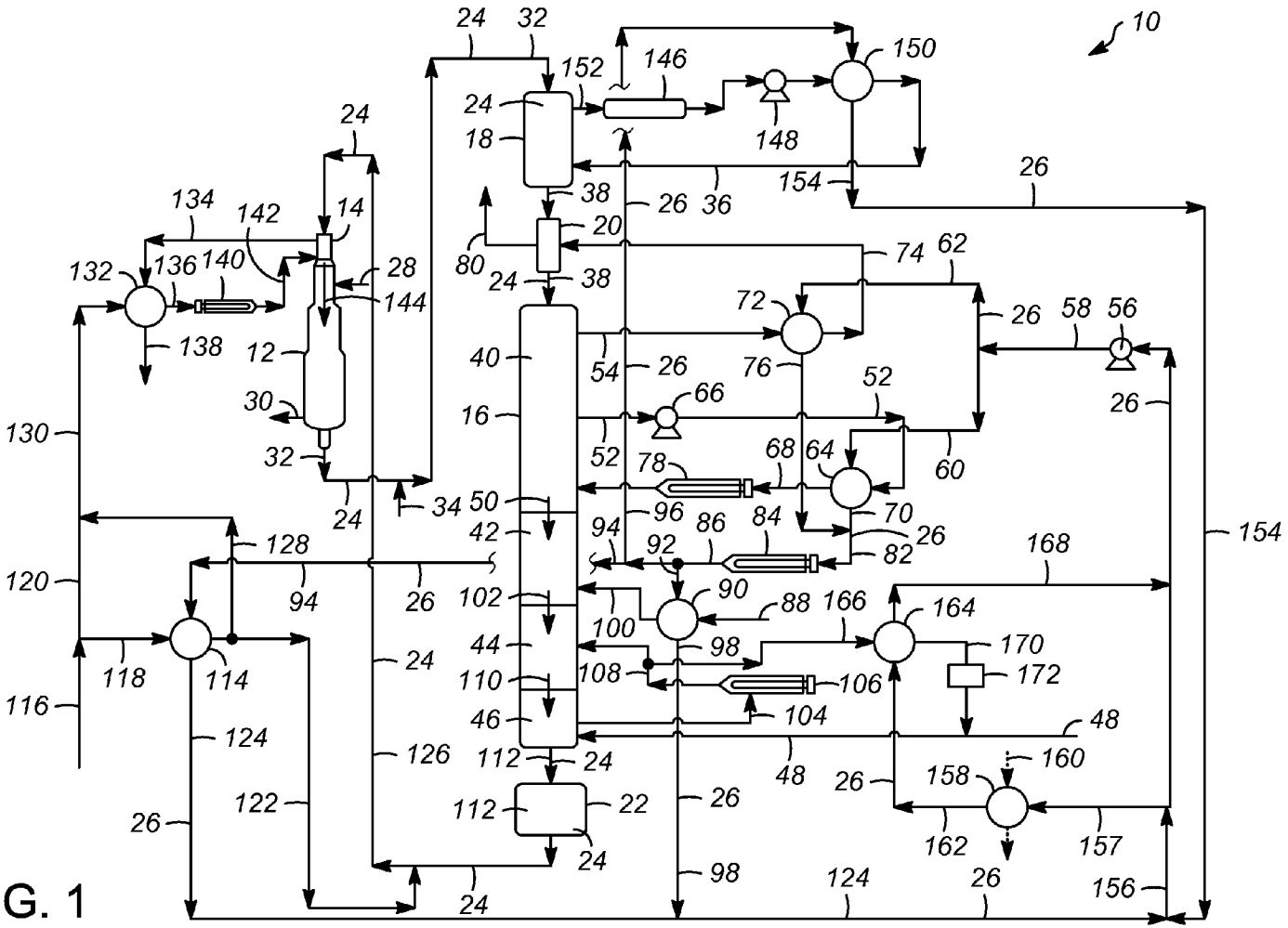
FIG. 1 schematically illustrates an apparatus and a method for catalytic reforming of hydrocarbons including regeneration of a catalyst in accordance with an exemplary embodiment.

Referring to FIG. 1, an apparatus 10 for catalytic reforming of hydrocarbons including regeneration of a catalyst in accordance with an exemplary embodiment is provided. The apparatus 10 comprises a reaction zone 12, a reduction zone 14, a regenerator 16, a spent catalyst hopper 18, a chloride adsorber 20, and a regenerated catalyst hopper 22 that are in fluid communication for advancing a catalyst 24 for catalytic reforming of hydrocarbons through the apparatus 10. As used herein, the term "zone" refers to an area including one or more equipment items and/or one or more sub-zones. Equipment items can include one or more reactors or reactor vessels, scrubbers, strippers, fractionators or distillation columns, absorbers or absorber vessels, regenerators, heaters, exchangers, coolers/chillers, pipes, pumps, compressors, controllers, and the like. Additionally, an equipment item can further include one or more zones or sub-zones.

As will be discussed in further detail below, a fluid circuit 26 containing an inert gas is configured to advance the inert gas through the fluid circuit 26 for indirect heat exchange with various streams that are in fluid communication with the catalyst 24. The inert gas can be nitrogen, argon, or any other gas that does not react or otherwise detrimentally affect the catalyst 24 if the inert gas unintentionally leaks into one of the various streams in fluid communication with the catalyst 24 and contacts the catalyst 24. In an exemplary embodiment, the inert gas is nitrogen.

In an exemplary embodiment, a feedstock 28 containing naphtha fraction hydrocarbons, such as from $C_5$ to about $C_{11}$ hydrocarbons with a boiling point range of, for example, from about 70 to about 205° C., is introduced to the reaction zone 12. As used herein, $C_x$ means hydrocarbon molecules that have "X" number of carbon atoms, $C_x^+$ means hydrocarbon molecules that have "X" and/or more than "X" number of carbon atoms, and $C_x^-$ means hydrocarbon molecules that have "X" and/or less than "X" number of carbon atoms. The reaction zone 12 contains the catalyst 24 for reforming of the hydrocarbons in the feedstock 28. Reforming catalysts are well-known in the art and typically contain a chloride compound(s) and a noble metal(s), such as platinum. The reaction zone 12 typically comprises a plurality of stacked reactors with provisions for intermediate heating. In the reaction zone 12, the feedstock 28 contacts the catalyst 24 at reaction conditions effective to form a reaction effluent 30 and a carbonaceous material (e.g., coke) is deposited onto the catalyst 24, which deactivates the catalyst 24 forming a spent catalyst 32. In an exemplary embodiment, the reaction effluent 30 contains $H_2$, $C_5^+$ hydrocarbons including aromatics, and lighter hydrocarbons such as $C_4^-$ hydrocarbons and exits the reaction zone 12 for separation and/or further processing.

The spent catalyst 32 can contain, for example, up to about 5 weight percent (wt. %) or more of coke. The spent catalyst 32 exits the reaction zone and is combined with a lift gas 34 (e.g., nitrogen gas) that carries the spent catalyst 32 to the spent catalyst hopper 18. As will be discussed in further detail below, a heated nitrogen gas stream 36 preheats the spent catalyst to form a preheated catalyst 38 (e.g., preheated spent catalyst). In an exemplary embodiment, the heated nitrogen gas stream 36 has a temperature of from about 110 to about 165° C. and the preheated catalyst 38 has a temperature of from about 110 to about 165° C., such as from about 130 to about 140° C. Additionally, the heated nitrogen gas stream 36 removes fines, dust, or other relatively small particulates from the spent catalyst 32 prior to exiting the spent catalyst hopper 18. As will be discussed in further detail below, the preheated catalyst 38 is passed through the chloride adsorber 20 and introduced to the regenerator 16.

The regenerator 16 comprises a combustion zone 40, a chlorination zone 42, a drying zone 44, and a cooling zone 46. An oxygen-containing gas stream 48 (e.g., a relatively low dew point air stream) is introduced to the regenerator 16 at the cooling zone 46 and at least a portion of the oxygen-containing gas stream 48 rises up through the drying zone 44, the chlorination zone 42, and into the combustion zone 40. In the combustion zone 40, coke is combustively removed from the preheated catalyst 38 in the presence of oxygen from the oxygen-containing gas stream 48 to form a spent catalyst 50 that is substantially depleted of coke and a heated combustion zone gas. In an exemplary embodiment, the combustion zone 40 operates at a temperature of from about 450 to about 580° C. In an exemplary embodiment, the heated combustion zone gas comprises nitrogen, oxygen, carbon dioxide, moisture, chloride compounds, and the like. As illustrated, the heated combustion zone gas is removed from the combustion zone 40 as two streams, a heated combustion zone gas stream 52 and a heated combustion zone gas stream 54.

A circulating device 56 (e.g., an inert gas blower such as a nitrogen gas blower) is disposed along and operatively coupled to the fluid circuit 26 for advancing the inert gas through the fluid circuit 26. In an exemplary embodiment, the circulating device 56 advances an inert gas stream 58 (e.g., nitrogen gas stream) that is divided into inert gas streams 60 and 62. In an exemplary embodiment, the inert gas stream 58 has a temperature of from about 65 to about 120° C., such as from about 90 to about 95° C.

As illustrated, the inert gas stream 60 is passed to a regeneration heat exchanger 64 and the heated combustion zone gas stream 52 is passed through a blower 66 to the regeneration heat exchanger 64. In the regeneration heat exchanger 64, heat from the heated combustion zone gas stream 52 is indirectly exchanged with the inert gas stream 60 to form a partially cooled combustion zone gas stream 68 and a heated inert gas stream 70. Likewise, the inert gas stream 62 is passed to a vent gas heat exchanger 72 for indirect heat exchange with the heated combustion zone gas stream 54 to form a partially cooled combustion zone vent gas stream 74 and a heated inert gas stream 76. In an exemplary embodiment, the partially cooled combustion zone gas stream 68 has a temperature of from about 450 to about 500° C., such as from about 475 to about 480° C., during normal or steady-state operation and may optionally be heated, during startup operation by being passed through a regeneration electric heater 78 to ensure that the partially cooled combustion zone gas stream 68 has a temperature of at least 450° C. before being returned back to the combustion zone 40. In an exemplary embodiment, the partially cooled combustion zone vent gas stream 74 has a temperature of from about 120 to about 165° C., such as from about 135 to about 140° C. The partially cooled combustion zone vent gas stream 74 exits the vent gas heat exchanger 72 and is passed through the chloride adsorber 20 for removing any chloride compounds from the gas stream 74 to form a vent gas stream 80 that is removed from the apparatus 10.

As illustrated, the heated inert gas streams 70 and 76 are combined to form a heated inert gas stream 82 that is passed through an electric heater 84 and exits the electric heater 84 as a heated inert gas stream 86. Depending on the amount of coke that is disposed on the preheated catalyst 38, the heated inert gas stream 82 has a temperature of from about 315 to about 415° C. However, if the amount of coke that is disposed on the preheated catalyst 38 is relatively low, e.g., less than about 5 wt. %, such that the heated inert gas stream 82 is only partially heated and has a temperature of less than about 315° C., then the heated inert gas stream 82 may be further heated by operating the electric heater 84 to further heat the heated inert gas stream 82 such that the heated inert gas stream 86 has a temperature of from about 315 to about 415° C.

As illustrated, the spent catalyst 50 descends to the chlorination zone 42 in the regenerator 16. An organic chloride-containing stream 88 is introduced to a heat exchanger 90. In an exemplary embodiment, the organic chloride-containing stream 88 comprises trichloroethylene, perchloroethylene, carbon tetrachloride, chlorine gas, or a combination thereof. As illustrated, the heated inert gas stream 86 is divided into a heated inert gas stream 92, a heated inert gas stream 94, and a heated inert gas stream 96. The heated inert gas stream 92 is passed through the heat exchanger 90 for indirect heat exchange with the organic chloride-containing stream 88 to form a partially heated inert gas stream 98 and a heated organic chloride-containing stream 100 that is passed along to the chlorination zone 42. In an exemplary embodiment, the partially heated inert gas stream 98 has a temperature of from about 170 to about 250° C. and the heated organic chloride-containing stream 100 has a temperature of from about 150 to about 200° C., such as from about 175 to about 180° C. In the chlorination zone 42, the heated organic chloride-containing stream 100 contacts the spent catalyst 50 to redistribute the noble metal(s), e.g., platinum and/or the like, and replenish the chloride on the spent catalyst to restore the activity and form a regenerated catalyst 102.

As illustrated, the regenerated catalyst 102 descends to the drying zone 44. A portion of the oxygen-containing gas stream 48 exits the cooling zone 46 as a partially heated oxygen-containing gas stream 104 and is passed through an electric heater 106 to form a heated oxygen-containing gas stream 108. In an exemplary embodiment, the partially heated oxygen-containing gas stream 104 has a temperature of from about 400 to about 550° C. and the heated oxygen-containing gas stream 108 has a temperature of from about 550 to about 600° C., such as from about 565 to about 570° C. The heated oxygen-containing gas stream 108 is introduced to the drying zone 44 and contacts the regenerated catalyst 102 to reduce the moisture content of the regenerated catalyst 102 and form a regenerated catalyst 110 that is substantially depleted of moisture.

The regenerated catalyst 110 descends to the cooling zone 46 and is contacted with the oxygen-containing gas stream 48 to cool the regenerated catalyst and form a regenerated catalyst 112. In an exemplary embodiment, the oxygen-containing gas stream 48 has a temperature of from about 20 to about 50° C., such as from about 35 to about 40° C., and the regenerated catalyst 112 has a temperature of from about 75 to about 200° C. The regenerated catalyst 112 exits the regenerator 16 and is passed along to the regenerated catalyst hopper 22 where it is allowed to temporarily accumulate for subsequent transfer.

As illustrated, the heated inert gas stream 94 is passed along to the booster gas heat exchanger 114. A hydrogen gas stream 116 is divided into a hydrogen gas stream 118 and a hydrogen gas stream 120. The hydrogen gas stream 118 is passed through the booster gas heat exchanger 114 for indirect heat exchange with the heated inert gas stream 94 to form a heated hydrogen gas stream 122 and a partially heated inert gas stream 124. In an exemplary embodiment, the heated hydrogen gas stream 122 has a temperature of from about 150 to about 200° C., such as from about 175 to about 180° C., and the partially heated inert gas stream 124 has a temperature of from about 150 to about 250° C.

The regenerated catalyst 112 exits the regenerated catalyst hopper 22 and is combined with the heated hydrogen gas stream 122 that thereby lifts or otherwise carries the regenerated catalyst 112 in a combined regenerated catalyst-, hydrogen-containing stream 126. The combined regenerated catalyst-, hydrogen-containing stream 126 is passed along to the reduction zone 14. As illustrated, a side stream 128 of the heated hydrogen gas stream 122 is combined with the hydrogen gas stream 120 to form a partially heated hydrogen gas stream 130. In an exemplary embodiment, the partially heated hydrogen gas stream 130 has a temperature of from about 0 to about 75° C.

The partially heated hydrogen gas stream 130 is passed along to a reduction gas heat exchanger 132 for indirect heat exchange with a further heated hydrogen-, $H_2O$-containing gas stream 134 that is formed in the reduction zone 14 as discussed in further detail below to form a further partially heated hydrogen gas stream 136 and a partially cooled hydrogen-, $H_2O$-containing gas stream 138. In an exemplary embodiment, the further heated hydrogen-, $H_2O$-containing gas stream 134 has a temperature of from about 320 to about 380° C., the further partially heated hydrogen gas stream 136 has a temperature of from about 300 to about 360° C., and the partially cooled hydrogen-, $H_2O$-containing gas stream 138 has a temperature of from about 70 to about 110° C. such as from about 80 to about 85° C.

The further partially heated hydrogen gas stream 136 is passed through an electric heater 140 and is introduced to the reduction zone 14 as a heated hydrogen gas stream 142. In an exemplary embodiment, the heated hydrogen gas stream 142 has a temperature of from about 400 to about 580° C.

In the reduction zone, the regenerated catalyst 112 in the combined regeneration catalyst-, hydrogen-containing stream 126 is reduced by hydrogen gas contained in both the combined stream 126 and the heated hydrogen gas stream 142 to form a regenerated catalyst 144 and the further heated hydrogen-, $H_2O$-containing gas stream 134. In an exemplary embodiment, reducing the regenerated catalyst 112 changes the noble metal(s), e.g., platinum and/or the like, from various oxide states to a reduced metallic condition by reacting the oxide(s) with hydrogen gas to form water.

As discussed above, the regenerated catalyst 144 is passed along to the reaction zone 12 and contacts the feedstock 28 to form the reaction effluent 30 and the spent catalyst 32, which is then introduced to the spent catalyst hopper 18. In fluid communication with the spent catalyst hopper 18 is a dust collector vessel 146, a blower 148, and a preheat gas heat exchanger 150. The heated nitrogen gas stream 36 contacts the spent catalyst 32 to form the preheated catalyst 38 and to remove fines, dust or other relatively small particles from the spent catalyst 32 forming a partially cooled nitrogen gas stream 152 that contains the fines, dust or other relatively small particles. In an exemplary embodiment, the partially cooled nitrogen gas stream 152 has a temperature of from about 50 to about 105° C.

The partially cooled nitrogen gas stream 152 is passed through the dust collector vessel 146 to remove the fines, dust or other relatively small particles from the stream 152, which is then passed through the blower 148 and introduced to the preheat gas heat exchanger 150. As illustrated, the heated inert gas stream 96 is passed through the preheat gas heat exchanger 150 for indirect heat exchange with the partially cooled nitrogen gas stream 152 to form a partially heated inert gas stream 154 and the heated nitrogen gas stream 36. In an exemplary embodiment, the partially heated inert gas stream 154 has a temperature of from about 160 to about 250° C.

As illustrated, the partially heated inert gas streams 98, 124, and 154 are passed along and combined to form a combined partially heated inert gas stream 156. A portion 157 of the combined partially heated inert gas stream 156 is passed through a cooler 158 (e.g., cooler configured for indirect heat exchange with a water stream 160) to form a partially cooled combined inert gas stream 162. In an exemplary embodiment, the partially cooled combined inert gas stream 162 has a temperature of from about 40 to about 90° C. As illustrated, the partially cooled combined inert gas stream 162 is passed along to a cooling zone heat exchanger 164 for indirect heat exchange with a portion 166 of the heated oxygen-containing gas stream 108 to form a partially heated combined inert gas stream 168 and a partially cooled oxygen-containing gas stream 170. In an exemplary embodiment, the partially heated combined inert gas stream 168 has a temperature of from about 65 to about 120° C. and the partially cooled oxygen-containing gas stream 170 has a temperature of from about 45 to about 100° C., such as from about 70 to about 75° C. As illustrated, the partially cooled oxygen-containing gas stream 170 is passed through an ejecting device 172 and combined with the oxygen-containing gas stream 48. The partially heated combined inert gas stream 168 is combined with a remaining portion of the combined partially heated inert gas stream 156 for introduction to the circulating device 56 to form the inert gas stream 58 as discussed above.

In an exemplary embodiment, it has been surprisingly found that advantageously the apparatus 10 configured as discussed above (1) automatically adjust to the variations in the regeneration process duties under various modes of operation, (2) has almost negligible requirements for makeup inert gas as the fluid circuit 26 is configured as a loop, (3) intrinsically has a safe design in which inert nitrogen gas can be used as the inert gas at a relatively high pressure, (4) does not require steam heating, and/or (5) can operate independent of ambient atmospheric conditions.

The following is an example comparison of energy balance and steam balance of a conventional catalyst regeneration process for catalytic reforming of hydrocarbons versus an exemplary embodiment of a catalyst regeneration process for catalytic reforming of hydrocarbons that is similarly configured to the apparatus 10 illustrated in FIG. 1. The example is provided for illustration purposes only and is not meant to limit the various embodiments of apparatuses and methods for catalytic reforming of hydrocarbons including regeneration of catalyst in any way.

Example 1

TABLE 1

Conventional Catalyst Regeneration Process - Energy Balance:

| Equipment Name | Duty | UOM | In Existing Art |
|---|---|---|---|
| Vent Gas Cooler | 0.6503 | MMBtu/hour | Waste Heat |
| Regeneration Cooler | 3.131 | MMBtu/hour | Waste Heat |
| Booster Gas Heater | 2.502 | MMBtu/hour | Steam Heated |
| Preheat Gas Heater | 0.1963 | MMBtu/hour | Steam Heated |
| Chloride Heating | 0.001 | MMBtu/hour | Steam Heated |
| Air Preheater | 0.375 | MMBtu/hour | Steam Heated |
| Net Energy (Energy added to the system + Energy lost as waste heat) | 6.8556 | MMBtu/hour | |

TABLE 2

Conventional Catalyst Regeneration Process - Steam Balance

| Equipment Name | Steam required | UOM |
|---|---|---|
| Booster Gas Heater | 816 | lb/hour |
| Preheat Gas Heater | 221 | lb/hour |
| Chloride Heating | 4.41 | lb/hour |
| Air Preheater | 419 | lb/hour |
| Total Steam used | 1460.41 | lb/hour |

TABLE 3

Exemplary Catalyst Regeneration Process in Accordance with an Embodiment Illustrated in FIG. 1 - Energy Balance

| Equipment Name | Duty | UOM | FIG. 1 |
|---|---|---|---|
| Vent Gas Cooler | 0.6503 | MMBtu/hour | Used to heat inert gas -not a waste heat |
| Regeneration Cooler | 3.131 | MMBtu/hour | Used to heat inert gas -not a waste heat |
| Booster Gas Heater | 2.502 | MMBtu/hour | No steam used, hot inert gas is used instead |
| Preheat Gas Heater | 0.1963 | MMBtu/hour | No steam used, hot inert gas is used instead |
| Chloride Heating | 0.001 | MMBtu/hour | No steam used, hot inert gas is used instead |
| Air Preheater | 0 | MMBtu/hour | Exchanger does not exist |
| Nitrogen Cooler | 4.24 | MMBtu/hour | Waste heat |
| Net Energy (Energy added to the system + Energy lost as waste heat) | 4.24 | MMBtu/hour | |
| Energy Saved | 2.6156 | MMBtu/hour | |
| Energy Saved | 38 | percentage | |
| Annual energy saved (based on 8500 man hours per year) | 22232.6 | MMBtu | |

As illustrated in Table 3, no steam is required for catalyst regeneration in the apparatus 10 as illustrated in FIG. 1 and therefore, the amount of steam used in accordance with this exemplary embodiment compared to a conventional catalyst regeneration process (e.g., Table 2) is reduced by 100%, which in this example amounts to a savings of about 1460.4 lb/hour (about 12.41 million lb/year—based on 8500 man hours per year) with respect to the conventional catalyst regeneration process. Additionally and as shown in Table 3, the total energy saved for catalyst regeneration in the apparatus 10 as illustrated in FIG. 1 is about 38% with respect to the conventional catalyst regeneration process (e.g., Table 1).

Figure 2:
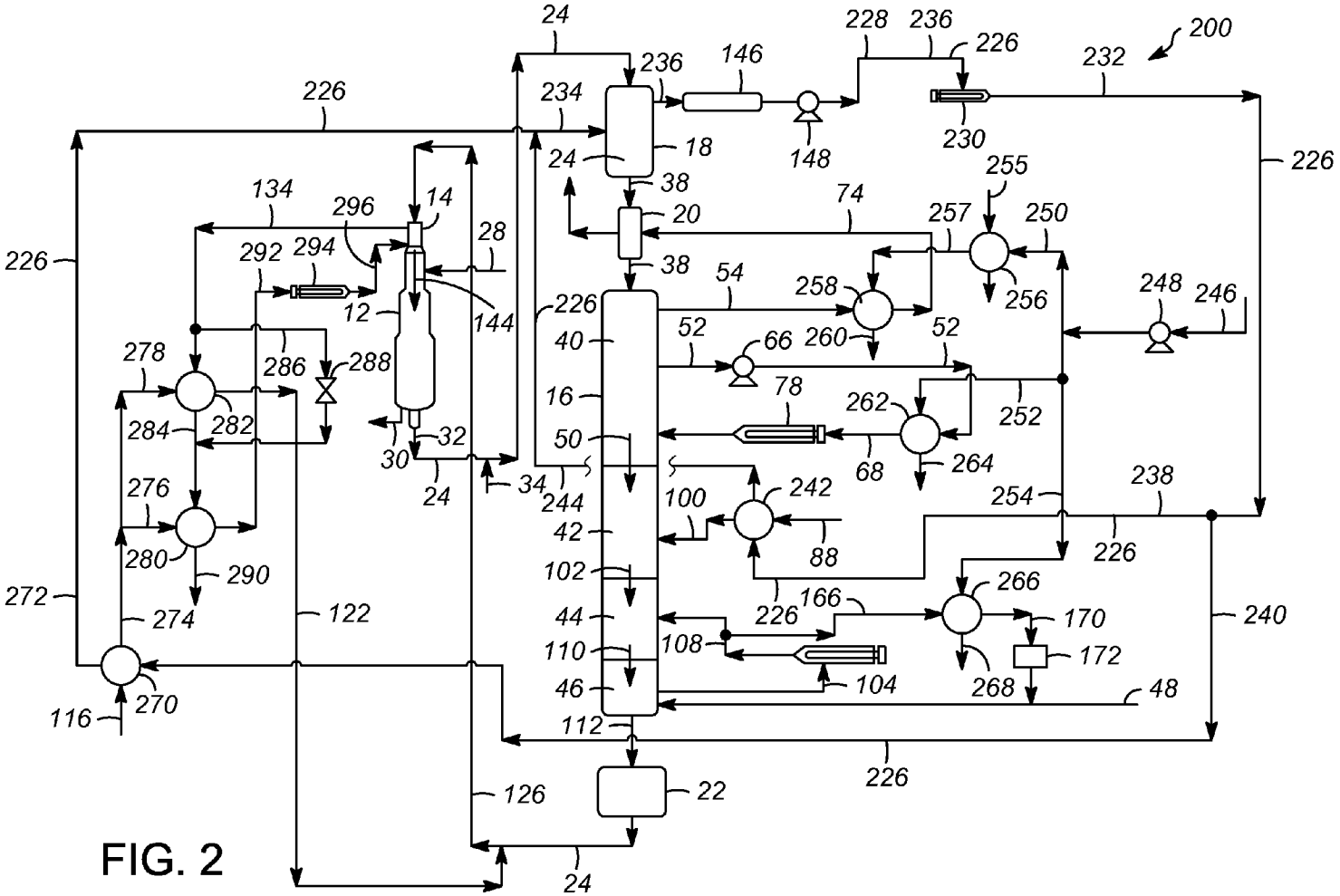
FIG. 2 schematically illustrates an apparatus and a method for catalytic reforming of hydrocarbons including regeneration of a catalyst in accordance with another exemplary embodiment.

Referring to FIG. 2, an apparatus 200 for catalytic reforming of hydrocarbons including regeneration of the catalyst 24 in accordance with an exemplary embodiment is provided. The apparatus 200 is similarly configured to the apparatus 10 including the reaction zone 12, the reduction zone 14, the regenerator 16, the spent catalyst hopper 18, the chloride adsorber 20, and the regenerated catalyst hopper 22 as discussed above in relation to FIG. 1 with at least the exceptions that a fluid circuit 226 contains a nitrogen gas stream 228 as the inert gas stream and is heated by a preheat gas heater (e.g., heating device) 230 to form a heated nitrogen gas stream 232 for indirect heat exchange with one or more streams for lifting the catalyst 24 and/or for chlorinating the catalyst 24 and further, for forming a partially heated nitrogen gas stream 234 for direct heat exchange with the catalyst 24 to form the preheated catalyst 38.

In particular and in an exemplary embodiment, the preheat gas heater 230 is configured as an electric heater and the nitrogen gas stream 228 is introduced to the preheat gas heater 230 as a partially cooled nitrogen gas stream 236 that is heated by the preheat gas heater 230 to form the heated nitrogen gas stream 232. In an exemplary embodiment, the partially cooled nitrogen gas stream 236 has a temperature of from about 50 to about 105° C. and the heated nitrogen gas stream 232 has a temperature of from about 400 to about 455° C., such as from about 425 to about 430° C.

As illustrated, the heated nitrogen gas stream 232 is divided into a heated nitrogen gas stream 238 and a heated nitrogen gas stream 240. The heated nitrogen gas stream 238 is passed along to the heat exchanger 242 for indirect heat exchange with the organic chloride-containing stream 88 as discussed above to form a partially heated nitrogen gas stream 244 and the heated organic chloride-containing stream 100. In an exemplary embodiment, the partially heated nitrogen gas stream 244 has a temperature of from about 110 to about 170° C.

An oxygen-containing gas stream 246 (e.g., atmospheric air) is passed through a blower 248 and is divided into an oxygen-containing gas stream 250, an oxygen-containing gas stream 252, and an oxygen-containing gas stream 254. In an exemplary embodiment, the oxygen-containing gas stream 246 has a temperature that matches or is substantially similar to atmospheric conditions, such as, depending upon location, of from about −40 to about 65° C. The oxygen-containing gas stream 250 is passed through a preheater 256 (e.g., air preheater that uses a heated air stream 255 for indirect heat exchange) to form a partially heated oxygen-containing gas stream 257. In an exemplary embodiment, the partially heated oxygen-containing gas stream 257 has a temperature of from about 65 to about 125° C., such as from about 90 to about 100° C.

As discussed above, in the combustion zone 40, coke is combustively removed from the preheated catalyst 38 in the presence of oxygen to form the spent catalyst 50 and the heated combustion zone gas, which is removed from the combustion zone 40 as two streams, the heated combustion zone gas stream 52 and the heated combustion zone gas stream 54. The partially heated oxygen-containing gas stream 257 and the heated combustion zone gas stream 54 are introduced to a vent gas heat exchanger 258 for indirect heat exchange to form the partially cooled combustion zone vent gas stream 74 and a heated oxygen-containing gas stream 260 that is vented, for example, to the atmosphere. As discussed above, the spent catalyst 50 descends from the combustion zone 40 to the chlorination zone 42 for contact with the heated organic chloride-containing stream 100 to form the regenerated catalyst 102.

The heated combustion zone gas stream 52 is passed through the blower 66 to a regeneration heat exchanger 262 for indirect heat exchange with the oxygen-containing gas stream 252 to form the partially cooled combustion zone gas stream 68 and a heated oxygen-containing gas stream 264 that is vented, for example, to the atmosphere. As illustrated and as discussed above, the partially cooled combustion zone gas stream 68 is passed through the regeneration electric heater 78 and optionally further heated (e.g., startup operation) for recycling back to the combustion zone 40.

The oxygen-containing gas stream 254 is passed through a cooling zone heat exchanger 266 for indirect heat exchange with the portion 166 of the heated oxygen-containing gas stream 108 to form the partially cooled oxygen-containing gas stream 170 and a heated oxygen-containing gas stream 268. As illustrated, the heated oxygen-containing gas stream 268 is vented, for example, to the atmosphere.

In an exemplary embodiment, the heated nitrogen gas stream 240 is passed along and introduced to a tempering heat exchanger 270 for indirect heat exchange with the hydrogen gas stream 116 to form a partially heated nitrogen gas stream 272 and a partially heated hydrogen gas stream 274. In an exemplary embodiment, the partially heated nitrogen gas stream 272 has a temperature of from about 130 to about 170° C. and the partially heated hydrogen gas stream 274 has a temperature of from about 60 to about 110° C. As illustrated, the partially heated nitrogen gas streams 244 and 272 are combined to form the partially heated nitrogen gas stream 234 for direct heat exchange with the spent catalyst 32 for forming the preheated catalyst 38 as discussed above. In an exemplary embodiment, the partially heated nitrogen gas stream 234 has a temperature of from about 130 to about 170° C., such as from about 135 to about 140° C.

As illustrated, a portion 276 and a remaining portion 278 of the partially heated hydrogen gas stream 274 are introduced to the reduction gas heat exchanger 280 and the booster gas heat exchanger 282, respectively. As discussed above, in the reduction zone 14, the regenerated catalyst 112 is reduced by hydrogen gas to form the regenerated catalyst 144 and the further heated hydrogen-, $H_2O$-containing gas stream 134. The further heated hydrogen-, $H_2O$-containing gas stream 134 is passed along and introduced to the booster gas heat exchanger 282 for indirect heat exchange with the portion 278 of the partially heated hydrogen gas stream 274 to form a heated hydrogen-, $H_2O$-containing gas stream 284 and the heated hydrogen gas stream 122 as discussed above for lifting the regenerated catalyst 112 in the combined regenerated catalyst-, hydrogen-containing stream 126 to the reduction zone 14. In an exemplary embodiment, the heated hydrogen-, $H_2O$-containing gas stream 284 has a temperature of from about 265 to about 365° C. In an exemplary embodiment, a bypass 286 with a valve 288 is provided to optionally direct a portion of the further heated hydrogen-, $H_2O$-containing gas stream 134 to be combined with the heated hydrogen-, $H_2O$-containing gas stream 284 downstream from the booster gas heat exchanger 282 to help control the temperature of the heated hydrogen-, $H_2O$-containing gas stream 284.

The portion 276 of the partially heated hydrogen gas stream 274 is passed through the reduction gas heat exchanger 280 for indirect heat exchange with the heated hydrogen-, $H_2O$-containing gas stream 284 to form an additional heated hydrogen-, $H_2O$-containing gas stream 290 and an additional heated hydrogen gas stream 292. In an exemplary embodiment, the additional heated hydrogen gas stream 292 has a temperature of from about 270 to about 330° C. As illustrated, the additional heated hydrogen gas stream 292 is passed through an electric heater 294 to form an additional heated hydrogen gas stream 296 for introduction to the reduction zone 14 for reducing the regenerated catalyst 112. In an exemplary embodiment, the additional heated hydrogen gas stream 296 has a temperature of from about 400 to about 580° C.

In an exemplary embodiment, it has been surprisingly found that advantageously the apparatus 200 configured as discussed above at least partially eliminates the usage of steam compared to conventional catalytic reforming apparatuses. Additionally, for low temperature hydrogen, it can be difficult to exchange indirect heat with the reduction zone gas since there are chances of corrosion, so the tempering heat exchanger heats the hydrogen to an appropriate temperature before indirect heat exchange with the reduction gas.

The following is an example of energy balance and steam balance, in accordance with an exemplary embodiment, of a catalyst regeneration process for catalytic reforming of hydrocarbons that is similarly configured to the apparatus 200 illustrated in FIG. 2. The example is provided for illustration purposes only and is not meant to limit the various embodiments of apparatuses and methods for catalytic reforming of hydrocarbons including regeneration of catalyst in any way.

Example 2

TABLE 4

Exemplary Catalyst Regeneration Process in Accordance with an Embodiment Illustrated in FIG. 2 - Energy Balance:

| Equipment Name | Duty | UOM | FIG. 2 |
|---|---|---|---|
| Vent Gas Cooler | 0.6503 | MMBtu/hour | Waste Heat |
| Regeneration Cooler | 3.131 | MMBtu/hour | Waste Heat |
| Booster Gas Heater | 2.502 | MMBtu/hour | No steam used, hot Nitrogen heated |
| Preheat Gas Heater | 1.007 | MMBtu/hour | No steam used, electrical heating instead |
| Chloride Heating | 0.001 | MMBtu/hour | No steam used, hot Nitrogen heated |
| Air Preheater | 0.375 | MMBtu/hour | Steam Heated |
| Net Energy (Energy added to the system + Energy lost as waste heat) | 5.1633 | MMBtu/hour | |
| Energy Saved | 1.6923 | MMBtu/hour | |
| Energy Saved | 24.7 | Percentage | |
| Annual energy saved (based on 8500 man hours per year) | 14384.55 | MMBtu | |

TABLE 5

Exemplary Catalyst Regeneration Process in Accordance with an Embodiment Illustrated in FIG. 2 - Steam balance

| Equipment Name | Steam required | UOM |
|---|---|---|
| Air Preheater | 419 | lb/hour |
| Total Steam used | 419 | lb/hour |
| Steam saved | 1041.41 | lb/hour |

TABLE 5-continued

| Exemplary Catalyst Regeneration Process in Accordance with an Embodiment Illustrated in FIG. 2 - Steam balance | | |
|---|---|---|
| Equipment Name | Steam required | UOM |
| Steam saved (based on 8500 man hours per year) | 8.9 | million lb per year |
| Steam usage reduced | 71.3 | percentage |

As illustrated in Table 4, the total energy saved for catalyst regeneration in the apparatus 200 as illustrated in FIG. 2 is about 24.7% with respect to the conventional catalyst regeneration process illustrated in Table 1. Additionally, with respect to Table 5, in an exemplary embodiment, the Air Preheater is the only exchanger in which steam is used for the regeneration of catalyst in the apparatus 200. Furthermore and as illustrated in Table 5, the amount of steam usage is reduced by about 71.3% with respect to the conventional catalyst regeneration process illustrated in Table 2, which amounts to a steam savings of 1041.4 lb/hour (about 8.9 million lb/year—based on 8500 man hours per year).

While at least one exemplary embodiment has been presented in the foregoing detailed description of the disclosure, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed description will provide those skilled in the art with a convenient road map for implementing an exemplary embodiment of the disclosure. It being understood that various changes may be made in the function and arrangement of elements described in an exemplary embodiment without departing from the scope of the disclosure as set forth in the appended claims.

What is claimed is:

1. A method for catalytic reforming of hydrocarbons including regeneration of a catalyst, the method comprising the steps of:

heating an inert gas to form a heated inert gas stream;

indirect heat exchanging at least a first portion of the heated inert gas stream with hydrogen gas to form a first partially heated inert gas stream and a heated hydrogen gas stream that is for lifting the catalyst; and/or indirect heat exchanging at least a second portion of the heated inert gas stream with an organic chloride-containing stream to form a second partially heated inert gas stream and a heated organic chloride-containing stream that is for chlorinating the catalyst; and/or preheating the catalyst using at least a third portion of the heated inert gas stream for indirect heat exchange with a nitrogen gas stream that is in fluid communication with the catalyst or using the first and/or second partially heated inert gas streams for direct heat exchange with the catalyst.

2. The method of claim 1, further comprising the step of:

combusting coke disposed on the catalyst in the presence of an oxygen-containing gas to form a heated combustion zone gas, and wherein heating the inert gas comprises indirect heat exchanging the heated combustion zone gas with the inert gas.

3. The method of claim 2, wherein heating the inert gas comprises forming the heated inert gas stream having a first temperature of from about 315 to about 415° C., and wherein if indirect heat exchanging the heated combustion zone gas with the inert gas only partially heats the inert gas to a second temperature of less than about 315° C. thereby forming a third partially heated inert gas stream, then the third partially heated inert gas stream is further heated by an electric heater to form the heated inert gas stream.

4. The method of claim 1, wherein indirect heat exchanging at least the first portion of the heated inert gas stream comprises forming the heated hydrogen gas stream having a temperature of from about 150 to about 200° C.

5. The method of claim 1, wherein indirect heat exchanging at least the second portion of the heated inert gas stream comprises forming the heated organic chloride-containing stream having a temperature of from about 170 to about 270° C.

6. The method of claim 1, wherein preheating the catalyst comprises indirect heat exchanging the third portion of the heated inert gas stream with the nitrogen gas stream to form a heated nitrogen gas stream; and contacting a spent catalyst with the heated nitrogen gas stream to form a preheated spent catalyst.

7. The method of claim 1, wherein preheating the catalyst using at least the third portion of the heated inert gas stream forms a third partially heated inert gas stream, and wherein the method further comprises the steps of:

combining at least two of the first partially heated inert gas stream, the second partially heated inert gas stream, and/or the third partially heated inert gas stream to form a combined partially heated inert gas stream; and introducing at least a portion of the combined partially heated inert gas stream to a circulating device that is operatively coupled to a fluid circuit for advancing the inert gas through the fluid circuit for heating the inert gas and further for indirect heat exchange with the hydrogen gas, the organic chloride-containing stream, and/or the nitrogen gas stream.

8. The method of claim 7, further comprising the steps of:

partially cooling a first portion of the combined partially heated inert gas stream to form a partially cooled combined inert gas stream;

indirect heat exchanging the partially cooled combined inert gas stream with a heated oxygen-containing gas stream to form a partially heated combined inert gas stream and a partially cooled oxygen-containing gas stream; and combining the partially heated combined inert gas stream with a remaining portion of the combined partially heated inert gas stream for introduction to the circulating device.

9. The method of claim 1, wherein the inert gas is an inert gas stream that forms the nitrogen gas stream, and wherein preheating the catalyst comprises preheating spent catalyst using the first and/or second partially heated inert gas streams for contact with a spent catalyst to form a partially cooled nitrogen gas stream and a preheated spent catalyst, and wherein heating the inert gas stream comprises heating the partially cooled nitrogen gas stream with a preheat gas heater to form a heated nitrogen gas stream as the heated inert gas stream.

10. The method of claim 9, wherein heating the inert gas stream comprises heating the partially cooled nitrogen gas stream with the preheat gas heater that is configured as an electric heater.

11. The method of claim 9, wherein heating the inert gas stream comprises forming the heated nitrogen gas stream having a temperature of from about 400 to about 455° C.

12. The method of claim 9, wherein indirect heat exchanging at least the first portion of the heated inert gas stream comprises indirect heat exchanging a first portion of the heated nitrogen gas stream with the hydrogen gas to form a first partially heated nitrogen gas stream as the first partially heated inert gas stream and a partially heated hydrogen gas stream, and wherein the method further comprises the steps of:

lifting the catalyst to a reduction zone with the heated hydrogen gas stream for reducing the catalyst and forming a further heated hydrogen-, $H_2O$-containing gas stream; and indirect heat exchanging the partially heated hydrogen gas stream with the further heated hydrogen-, $H_2O$-containing gas stream to form the heated hydrogen gas stream and a heated hydrogen-, $H_2O$-containing gas stream.

13. The method of claim 12, wherein indirect heat exchanging at least the first portion of the heated inert gas stream comprises forming the partially heated hydrogen gas stream having a temperature of from about 60 to about 110° C.

14. The method of claim 12, further comprising the step of:

indirect heat exchanging a portion of the partially heated hydrogen gas stream with the heated hydrogen-, $H_2O$-containing gas stream to form an additional heated hydrogen gas stream for introduction to the reduction zone for reducing the catalyst.

15. The method of claim 9, wherein indirect heat exchanging at least the second portion of the heated inert gas stream comprises indirect heat exchanging a second portion of the heated nitrogen gas stream with the organic chloride-containing stream to form a second partially heated nitrogen gas stream as the second partially heated inert gas stream and the heated organic chloride-containing stream.

* * * * *